United States Patent [19]

Watanabe et al.

[11] 4,319,158

[45] Mar. 9, 1982

[54] ELECTRODE FOR DISCHARGE LAMP

[75] Inventors: Keiji Watanabe; Masato Saito; Keiji Fukuyama, all of Kamakura, Japan

[73] Assignee: Mitsubishi Denki Kabushiki Kaisha, Tokyo, Japan

[21] Appl. No.: 108,173

[22] Filed: Dec. 28, 1979

[30] Foreign Application Priority Data

| | | | |
|---|---|---|---|
| Dec. 29, 1978 | [JP] | Japan | 53-164286 |
| Dec. 29, 1978 | [JP] | Japan | 53-164287 |
| Dec. 29, 1978 | [JP] | Japan | 53-164288 |
| Jun. 22, 1979 | [JP] | Japan | 54-78867 |
| Jun. 22, 1979 | [JP] | Japan | 54-78868 |
| Jun. 22, 1979 | [JP] | Japan | 54-78869 |

[51] Int. Cl.[3] ..... H01J 1/14; H01J 19/06; H01K 1/04

[52] U.S. Cl. ..... 313/346 R; 313/311; 313/213; 313/218; 252/521

[58] Field of Search ..... 313/346 R, 311, 352, 313/213, 218; 252/521

[56] References Cited

U.S. PATENT DOCUMENTS 4,052,634 9/1980 Dekok ..... 313/346 R

FOREIGN PATENT DOCUMENTS 2753039 1/1978 Fed. Rep. of Germany ..... 313/218

*Primary Examiner*—Saxfield Chatmon, Jr.
*Attorney, Agent, or Firm*—Oblon, Fisher, Spivak, McClelland & Maier

[57] ABSTRACT

An electrode for a discharge lamp such as high pressure metal vapor lamps and fluorescent lamps is improved by using an electron emission material comprising lanthanum oxide and yttrium oxide. The electron emission material can be a combination of lanthanum oxide and yttrium oxide with barium.strontium.calcium tungstate or an alkaline earth metal oxide including at least barium oxide.

When the electrode is used in a high pressure metal vapor discharge lamp, luminous flux maintenance percent in an initial lightening period is highly improved without forming a black deposition at an end of an arc tube.

When the electrode is used in a fluorescent lamp, a formation of a black deposition is prevented and a starting voltage is lowered.

2 Claims, 4 Drawing Figures

ELECTRODE FOR DISCHARGE LAMP

BACKGROUND OF THE INVENTION

1. Field of the Invention

The present invention relates to an electrode used in high pressure metal vapor discharge lamps such as a high pressure mercury vapor discharge lamp in which mercury and a rare gas are filled; a high pressure sodium vapor discharge lamp in which mercury, a rare gas and sodium are filled; a metal vapor discharge lamp in which mercury, a rare gas and a metal halide are filled or low pressure discharge lamps such as a fluorescent lamp. More particularly, it relates to an improvement of an electron emission material on the electrode.

2. Description of the Prior Arts

In a high pressure metal vapor discharge lamp such as a high pressure mercury vapor discharge lamp, a mixture of barium, strontium, calcium tungstate ($Ba_{2-x}Sr_xCaWO_6$: x is 0 to 0.5), beryllium oxide (BeO) and yttrium oxide ($Y_2O_3$) has been used as an electron emission material coated on the electrode. In the electron emission material, a solid solution of BeO and $Y_2O_3$ is formed whereby a lumen maintenance and a starting characteristic are advantageously excellent and stable during a long time operation of the lamps. However, BeO contained in the electron emission material is toxic to human body and the handling of the electron emission material should be carefully considered and the improvement of productivity is disadvantageously prevented. Moreover, in a high pressure metal vapor discharge lamp using the electron emission material, a phenomenon of the formation of black deposit is often found in the initial period. The black deposit is gradually changed to be white during the operation and it does not affect to the life characteristic of the lamp. However, it causes slightly low luminous flux value in the initial lightening period.

In a metal halide lamp, a rare earth metal oxide has been usually used as the electron emission material. Yttrium oxide is especially effective since it has excellent electron emitting characteristic. However, yttrium oxide has high melting point whereby the adhesion of the component on the electrode substrate is not satisfactorily attained to peel off the electron emission material during the operation of the discharge lamp. This causes deterioration of the activity of electron emission and the black coloring of the arc tube of the lamp is formed to cause a short life.

In a fluorescent lamp, an electron emission material of a mixture of barium, strontium, calcium carbonate and zirconium oxide is coated on a coil made of tungsten and the carbonate is thermally decomposed into oxides such as barium oxide in the step of preparing electrodes of a fluorescent lamp. The conventional electron emission material is reduced by tungsten as the electrode substrate during the operation of the discharge lamp and barium oxide (BaO) is converted into barium metal (Ba) by the following reaction.

$$6BaO + W \rightarrow Ba_3WO_6 + 3Ba.$$

The barium metal contributes to the electron emission from the electrode, however, a part of the barium metal is sputtered in the arc space and is adhered on the inner wall of the arc tube. A black coloring may be caused at the end of the arc tube when the quantity of the barium metal is much. Zirconium oxide is incorporated to decrease the reduction by the electrode substrate and to decrease the sputtering of the barium metal. The end blacking of the tube can be decreased by the incorporation of zirconium oxide, however, it may cause deterioration of the activity of electron emission of the electrode. When such electrode is used in the fluorescent lamp, the starting voltage is disadvantageously high.

SUMMARY OF THE INVENTION

It is an object of the present invention to overcome the disadvantages of the conventional electrode and to provide an electrode in which an adhesion of an electron emission material on an electrode substrate is remarkably improved and which has excellent electron emitting activity to result less luminous flux deterioration in a metal vapor discharge lamp. The foregoing and other objects of the present invention have been attained by using an electron emission material comprising yttrium oxide and lanthanum oxide.

The other object of the present invention is to provide an electrode of a discharge lamp in which a starting voltage of the discharge lamp is lowered and an arc tube end blacking is decreased. This is attained by using an electron emission material comprising yttrium oxide and lanthanum oxide.

The other object of the present invention is to provide an electrode of a discharge lamp by which an initial deterioration of luminous flux is decreased and which does not contain toxic BeO so as to eliminate a special handling operation and to attain a normal operation and to improve its productivity. This is attained by using an electron emission material comprising yttrium oxide and lanthanum oxide.

DETAILED DESCRIPTION OF THE PREFERRED EMBODIMENTS

The electrode of the metal vapor discharge lamp of the present invention will be illustrated.

Figure 1:
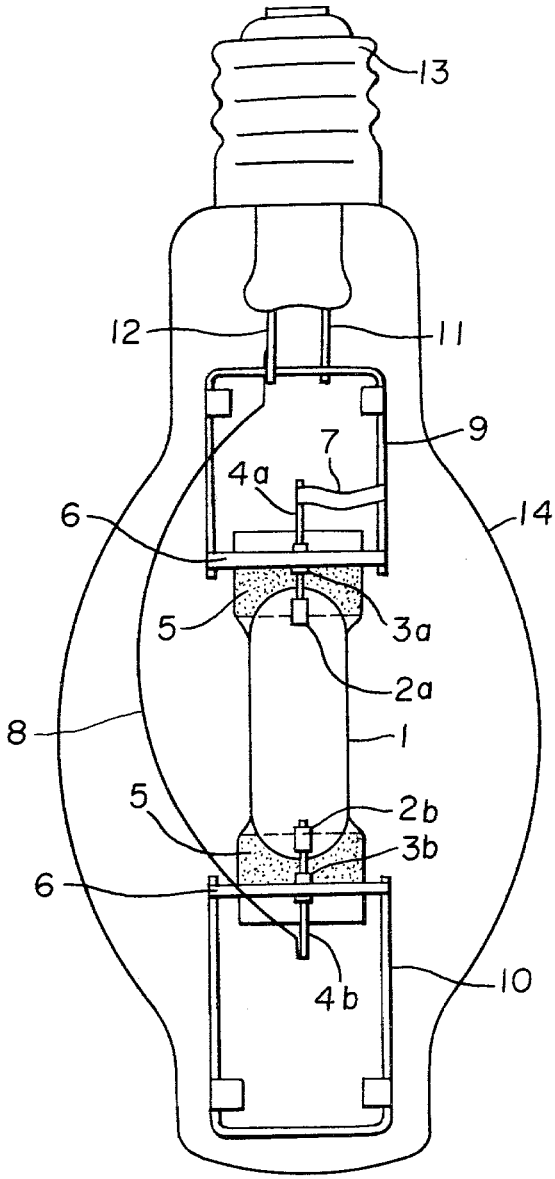
FIG. 1 is a front view for showing a structure of a metal vapor discharge lamp.

The metal vapor discharge lamp has the structure shown in FIG. 1 wherein the reference numeral (1) designates an arc tube made of a transparent quartz glass in which mercury, a rare gas and a metal halide are filled and **(2*a*) and (2*b*) designate electrodes which are placed at both ends of the arc tube to face each other and are respectively connected through each molybdenum foil (3*a*), (3*b*) sealed at each end of the arc tube (1) to each lead wire (4*a*), (4*b*); and (5) and (5) designate heat reserve layers coated at each end of the arc tube (1); (6) and (6) designate supporting plates which are placed at each end of the arc tube (1) and welded on each frame (9), (10) so as to hold the arc tube (1) in an outer tube (14); and (7) designates a ribbon lead wire which connects the lead wire (4*a*) to the frame (9); (11) designates a stem lead which is welded to the frame (9); (12) designates the other stem lead; (8) designate an arch shaped wire for connecting the lead wire (4*b*) to the stem lead (12); and (13) designates a base which is placed at one edge of the outer tube and is connected to the stem leads (11), (12)**.

Figure 2:
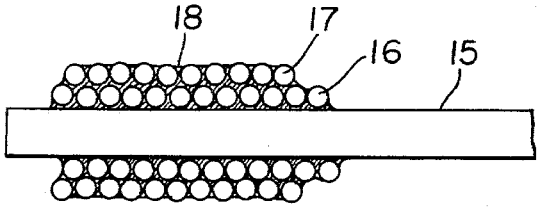
FIGS. 2, 3 and 4 are respectively sectional views of various structures of the electrode of the metal vapor discharge lamp.

As shown in FIG. 2, each of the electrodes (2*a*), (2*b*) comprises an electrode core (15) made of a heat resistant metal such as tungsten and an inner coil (16) and an outer coil (17) which are wound on the electrode core; and an electron emission material (18) which is formed by coating on the inner coil (16) and the outer coil (17) and sintering it at high temperature.

The present invention will be illustrated by certain examples and references as the comparison.

A conventional embodiment will be illustrated.

A tungsten rod having a diameter of 0.9 mm is used as the electrode core (15) and a tungsten wire having a diameter of 0.5 mm is used as the inner coil (16) and the outer coil (17) so as to form the electrode substrate.

An electron emission material of only yttrium oxide is admixed with nitrocellulose lacquer and butyl acetate and the mixture is milled in a ball mill for 24 hours to prepare a suspension. The electrode substrate is dipped into the suspension to coat the electron emission material on the inner coil (16) and the outer coil (17) and this is dried and sintered in an argon atmosphere at 1800° C. for 2 minutes so as to bond the electron emission material (18) on the electrode substrate.

The electrodes (2*a*), (2*b*) coated with the electron emission material (18) are used for preparing a 400 W metal vapor discharged lamp equipped with the arc tube (1) having an inner diameter of 18 mm and a gap between the electrodes (2*a*), (2*b*) of 44 mm in which suitable quantities of mercury, argon gas, scandium iodide and sodium iodide are filled. The life test of the 400 W metal vapor discharge lamp is carried out. The lumen maintenance was 50% after 9000 hours of operation.

Examples of the present invention will be illustrated.

Lanthanum oxide is mixed with yttrium oxide at various ratios to form the electron emission material (18). The electrodes (2*a*), (2*b*) are prepared by coating the electron emission material on the electrode substrate. Various 400 W metal vapor discharge lamps are prepared by using the electrodes and the life tests are carried out as set forth in said reference. The results of the life tests are shown in Table 1.

TABLE 1

| | Composition of electron emission material (mol %) | Lumen maintenance after 9000 hours of operation (%) |
|---|---|---|
| Ref. | $Y_2O_3$ (100 mol %) | 50 |
| Exp. 1-1 | $Y_2O_3$(99.7 mol %) - $La_2O_3$(0.3 mol %) | 55 |
| Exp. 1-2 | $Y_2O_3$(99.5 mol %) - $La_2O_3$(0.5 mol %) | 60 |
| Exp. 1-3 | $Y_2O_3$(90 mol %) - $La_2O_3$(10 mol %) | 68 |
| Exp. 1-4 | $Y_2O_3$(80 mol %) - $La_2O_3$(20 mol %) | 75 |
| Exp. 1-5 | $Y_2O_3$(40 mol %) - $La_2O_3$(60 mol %) | 65 |
| Exp. 1-6 | $Y_2O_3$(20 mol %) - $La_2O_3$(80 mol %) | 61 |
| Exp. 1-7 | $Y_2O_3$(17 mol %) - $La_2O_3$(83 mol %) | 56 |

As it is shown in Table 1, the lumen maintenance of the metal vapor discharge lamps using the electron emission material shown in Examples are remarkably superior to that of the metal vapor discharge lamp using only yttrium oxide as the electron emission material (18).

The reason why the lumen maintenance of Examples are superior to that of Reference is considered as follows.

Yttrium oxide has a high melting point. When it is sintered after coating on the electrode substrate, the adhesion of yttrium oxide as the electron emission material (18) on the electrode substrate is not high enough and the electron emission material (18) is peeled off from the electrode substrate during the operation of the discharge lamp. When the electron emission material of only yttrium oxide is used as the conventional case, the luminous flux is reduced for a long time operation. However, when the electron emission material (18) of a mixture of yttrium oxide and lanthanum oxide is used as Examples, the mixture forms a solid solution or a complex compound of yttrium oxide and lanthanum oxide to decrease a melting point. Thus, the electron emission material is highly spread on the electrode substrate to improve the adhesion and accordingly, the peeling-off of the electron emission material in the discharge lamp is decreased whereby the excellent electron emitting activity of yttrium oxide is maintained for a long time to provide a discharge lamp having less luminous flux deterioration.

Moreover, as shown in Table 1, the optimum result is attained by using a mixture incorporating 0.5 to 80 mol % of lanthanum oxide. When a content of lanthanum oxide is less than 0.5 mol %, the effect of lowering of a melting point is too small to adhere it on the electrode substrate and the lumen maintenance is less than 60% to be small effect for improving the lumen maintenance. When it is more than 80 mol %, a content of yttrium oxide coated on the electrodes (2*a*), (2*b*) is relatively smaller so as to decrease the electron emitting activity. Therefore, the effect for improving the lumen maintenance is disadvantageously small.

In the examples, yttrium oxide has been used as the electron emission material. Thus, it is possible to incorporate a small amount of tungsten and/or molybdenum powder into the mixture.

Figure 3:
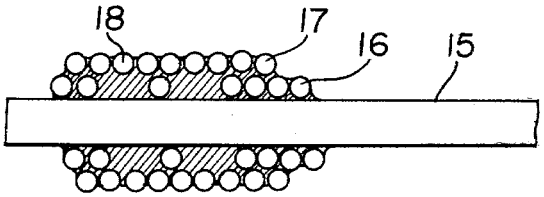
Figure 4:
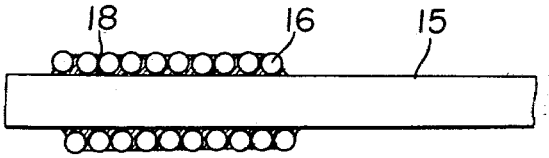

In the examples, the structure of the electrode shown in FIG. 2 has been used. The structure of the electrode is not limited to said feature and can be the other features, for example, the electrode shown in FIG. 3 wherein the inner coil (16) is wound on the electrode core (15) so as to remain rough wound parts and the outer coil (17) is wound on the inner coil to form the electrode substrate and the electron emission material (18) is filled in the space in the electrode substrate; or the electrode shown in FIG. 4 wherein only inner coil (16) is wound on the electrode core (15) to form the electrode substrate and the electron emission material (18) is coated on the electrode substrate. The present invention can be applied for various kinds of the structures of the electrodes.

In the examples, scandium iodide and sodium iodide have been filled in the arc tube of the metal vapor discharge lamp. Thus, it is possible to apply the present invention for the metal vapor discharge lamps in which the other halide such as dysprosium iodide, thallium iodide and indium iodide is filled.

In accordance with the above-mentioned embodiment, the electrodes prepared by using the electron emission material consisting of yttrium oxide and lanthanum oxide are used in the metal vapor discharge lamp containing the metal halide in the arc tube. Therefore, the adhesion of the electron emission material on the electrode substrate is remarkably superior and the electron emitting activity is highly maintained for its long life and the luminous flux deterioration is small and a life of the lamp is long.

The other embodiment of the electrode of a high pressure mercury vapor discharge lamp will be illustrated.

Certain examples and a reference of the embodiment will be illustrated.

In Reference, a tungsten rod having a diameter of 1.2 mm is used as the electrode core (15) and a tungsten wire having a diameter of 0.6 mm is used as the inner coil (16) and the outer coil (17) so as to form the electrode substrate.

An electron emission material (18) of a mixture of 15.2 mol % of barium·strontium·calcium tungstate ($Ba_{1.8}Sr_{0.2}CaWO_6$), 76.3 mol % of beryllium oxide (BeO) and 8.5 mol % of yttrium oxide ($Y_2O_3$) is admixed with nitrocellulose lacquer and butyl acetate and the mixture is milled in a ball mill for 24 hours to prepare a suspension. The electrode substrate is dipped into the suspension to coat the electron emission material on the electrode substrate and this is dried and sintered in an argon atmosphere at 1700° C. for 2 minutes so as to bond the electron emission material (18) on the electrode substrate.

The electrodes (2*a*), (2*b*) coated with the electron emission material (18) are used for preparing a 400 W high pressure mercury vapor discharge lamp equipped with the arc tube (1) having an inner diameter of 18 mm and an arc length of 70 mm in which suitable quantities of mercury and argon gas for starting are filled. The lamps are burned on a cycle of 15 minutes On and 15 minutes Off and lumen maintenance after 50 times and after 600 times are measured. The lumen maintenance is 86% after 50 times. A black deposition is found on the inner wall of the arc tube in the lamp. Beryllium and barium components are found by an analysis of the black deposition. The lumen maintenance is 70% after 6000 times.

Examples of the present invention will be illustrated.

Lanthanum oxide ($La_2O_3$) and yttrium oxide ($Y_2O_3$) are mixed with barium, strontium and calcium tungstate ($Ba_{1.8}Sr_{0.2}CaWO_6$) at various ratios to form each electron emission material (18). The electrodes (2*a*), (2*b*) are prepared by coating the electron emission material on the electrode substrate. Various 400 W high pressure mercury vapor discharge lamps are prepared by using the electrodes and the life tests are carried out as set forth in said reference. The results of the life tests are shown in Table 2.

TABLE 2

| | Composition of electron emission material (mol %) | | | | $La_2O_3 : Y_2O_3$ | Lumen maintenance (%) | |
|---|---|---|---|---|---|---|---|
| | $Ba_{1.8}Sr_{0.2}CaWO_6$ | $La_2O_3$ | $Y_2O_3$ | BeO | (molar ratio) | after 50 times | after 6000 times |
| Ref. | 15.2 | — | 8.5 | 76.3 | — | 86.0 | 70.0 |
| Exp. 2-1 | 15.2 | 4.8 | 80.0 | — | 1 : 17 | 91.0 | 65.0 |
| Exp. 2-2 | 15.2 | 8.5 | 76.3 | — | 1 : 9 | 95.0 | 76.0 |
| Exp. 2-3 | 15.2 | 21.2 | 63.6 | — | 1 : 3 | 98.0 | 80.0 |
| Exp. 2-4 | 15.2 | 70.7 | 14.1 | — | 5 : 1 | 96.0 | 78.0 |
| Exp. 2-5 | 15.2 | 80.6 | 4.2 | — | 19 : 1 | 93.0 | 74.0 |
| Exp. 2-6 | 15.2 | 81.4 | 3.4 | — | 24 : 1 | 90.0 | 64.0 |

As it is shown in Table 2, the lumen maintenance (after 50 times) of the lamps using the electron emission material (18) comprising $La_2O_3$ and $Y_2O_3$ and $Ba_{1.8}Sr_{0.2}CaWO_6$ are superior to that of the conventional electron emission material including BeO and $Y_2O_3$. When the molar ratio of $La_2O:Y_2O_3$ is in a range of 19:1 to 1:9, the lumen maintenance after 6000 times is superior to that of the conventional one.

The reason of these characteristics is considered as follows.

In the conventional electron emission material (18), a solid solution is formed by BeO and $Y_2O_3$ so as to improve the adhesion in the electrode substrate and a formation of an active barium component in operation is kept in a desired rate. However, the electron emission material (18) is coated on the electrode substrate and dried and bonded on it by sintering it at high temperature. BeO in the solid solution partially reacts with the tungstate in the electron emission material (18) to form a complex compounds having relatively low melting point such as BeO·3BaO. When an arc spot is shifted to the position forming the complex compounds on the electrode, the complex compounds are suddenly heated to high temperature so as to selectively vaporize Be and Ba to adhere them on the inner wall of the arc tube. Therefore, the deterioration of the luminous flux in the initial stage of operation is caused.

On the other hand, when the electron emission material (18) including $La_2O_3$ and $Y_2O_3$ is used, a solid solution or a stable complex compound is formed by $La_2O_3$ and $Y_2O_3$. Moreover, $La_2O_3$ and $Y_2O_3$ are not reactive to the tungstate. Therefore, the formation of the active barium from the electron emission material (18) is kept at a desired rate in a stable condition during the initial and the long time of operation and the lumen maintenance is stable during the life.

As described above, when the molar ratio of $La_2O_3$ to $Y_2O_3$ is in a range of 19:1 to 1:9, the above-mentioned effect is remarkable. When the molar ratio of $La_2O_3$ to $Y_2O_3$ is greater than 19:1, the melting point of the solid solution is too high and the adhesion of the electron emission material (18) to the electrode substrate is deteriorated and the lumen maintenance after 6000 times is slightly lower than that of the conventional one as shown in Table 2.

When the molar ratio of $La_2O_3$ to $Y_2O_3$ is less than 1:9, the melting point of the solid solution is too high and the adhesion of the electron emission material (18) to the electrode substrate is deteriorated and the lumen maintenance after 6000 times is lower.

In said examples, the effects of the present invention have been shown in the cases that the mol % of the barium.strontium.calcium tungstate is the same as that of the conventional one. Thus, the similar effect can be attained even though the mol % of the tungstate is different.

The effect of the present invention can be attained even though a small amount of $Al_2O_3$, $SiO_2$ or tungsten is included into said electron emission material (18) of the present invention.

In the examples, the structure of the electrode shown in FIG. 2 has been used. The structure of the electrode can be the other features, for example, the electrode shown in FIG. 3 wherein the inner coil (16) is wound on the electrode core (15) so as to remain rough wound parts and the outer coil (17) is wound on the inner coil to form the electrode substrate and the electron emission material (18) is filled in the space in the electrode substrate to be sintered.

In accordance with the following embodiment, the electron emission material of a mixture of barium oxide, calcium oxide, lanthanum oxide and yttrium oxide is used to improve the luminous flux deterioration in the initial period of operation and to improve the productivity of the discharge lamp since a toxic beryllium oxide is not used.

The embodiment of an electrode of a high pressure mercury vapor discharge lamp will be illustrated.

Certain examples and a reference of the embodiment will be illustrated.

In Reference, a tungsten rod having a diameter of 1.2 mm is used as the electrode core (15) and a tungsten were having a diameter of 0.6 mm is used as the inner coil (16) and the outer coil (17) so as to form the electrode substrate.

An electron emission material (18) of a mixture of 42.3 mol % of BaO, 16.5 mol % of CaO, 37.1 mol % of BeO and 4.1 mol % of $Y_2O_3$ is admixed with nitrocellulose lacquer and butyl acetate and the mixture is milled in a ball mill for 24 hours to prepare a suspension. The electrode substrate is dipped into the suspension to coat the electron emission material on the electrode substrate and this is dried and sintered in an argon atmosphere at 1700° C. for 2 minutes so as to bond the electron emission material (18) of the electrode substrate.

The electrodes (2*a*), (2*b*) coated with the electron emission material (18) are used for preparing a 400 W high pressure mercury vapor discharge lamp equipped with the arc tube (1) having an inner diameter of 18 mm and an arc length of 70 mm in which suitable quantities of the mercury and argon gas for starting are filled. The life tests are carried out as set forth in said reference and the lumen maintenance after 50 times and 6000 times are measured.

The lumen maintenance is 85% after 50 times. A black deposition is found on the inner wall of the arc tube in the lamp. Beryllium and barium components are found by an analysis of the black deposition. The lumen maintenance is 62% after 6000 times.

Examples of the present invention will be illustrated.

Barium oxide (BaO), calcium oxide (CaO) as alkaline earth metal oxides and lanthanum oxide ($La_2O_3$) and yttrium oxide ($Y_2O_3$) are mixed at various ratios to form each electron emission material (18). The electrodes (2*a*), (2*b*) are prepared by coating the electron emission material on the electrode substrate. Various 400 W high pressure mercury vapor discharge lamps are prepared by using the electrodes and life tests are carried out as set forth in said reference. The results of the life tests are shown in Table 3.

TABLE 3

| | Composition of electron emission material (mol %) | | | | | $La_2O_3 : Y_2O_3$ | Lumen maintenance (%) | |
|---|---|---|---|---|---|---|---|---|
| | BaO | CaO | $La_2O_3$ | $Y_2O_3$ | BeO | (molar ratio) | after 50 times | after 6000 times |
| Ref. | 42.3 | 16.5 | — | 4.1 | 37.1 | — | 85.0 | 62.0 |
| Exp. 3-1 | 42.3 | 16.5 | 3.2 | 38.0 | — | 1:12 | 90.0 | 58.0 |
| Exp. 3-2 | 42.3 | 16.5 | 4.2 | 37.0 | — | 1:9 | 93.0 | 69.0 |
| Exp. 3-3 | 42.3 | 16.5 | 10.3 | 30.9 | — | 1:3 | 97.0 | 73.0 |
| Exp. 3-4 | 42.3 | 16.5 | 36.0 | 5.2 | — | 7:1 | 95.0 | 70.0 |
| Exp. 3-5 | 42.3 | 16.5 | 39.1 | 2.1 | — | 19:1 | 92.0 | 67.0 |
| Exp. 3-6 | 42.3 | 16.5 | 39.4 | 1.8 | — | 22:1 | 89.0 | 56.0 |

As it is shown in Table 3, the lumen maintenance (after 50 times) of the lamps using the electron emission material (18) including $La_2O_3$ and $Y_2O_3$ are superior to that of the conventional electron emission material including BeO and $Y_2O_3$. When the molar ratio of $La_2O_3$:$Y_2O_3$ is in a range of 19:1 to 1:9 the lumen maintenance after 6000 times is superior to that of the conventional one.

The reason of these characteristics is considered as follows.

In the conventional electron emission material (18), a solid solution is formed by BeO and $Y_2O_3$ so as to improve the adhesion in the electrode substrate and a formation of an active barium component in operation is kept in a desired rate. However, the electron emission material (18) is coated on the electrode substrate and dried and bonded on it by sintering it at high temperature. BeO in the solid solution partially reacts with BaO in the electron emission material (18) to form a complex compounds having relatively low melting point such as BeO·3BaO. When an arc spot is shifted to the position forming the complex compounds on the electrode, the complex compounds are suddenly heated to high temperature so as to selectively vaporize Be and Ba to adhere them on the inner wall of the arc tube. Therefore, th deterioration of the luminous flux in the initial stage of operation is caused.

On the other hand, when the electron emission material (18) including $La_2O_3$ and $Y_2O_3$ is used, a solid solution or a stable complex compound is formed by $La_2O_3$ and $Y_2O_3$. Moreover, $La_2O_3$ and $Y_2O_3$ are not reactive to BaO. Therefore, the formation of the active barium from the electron emission material (18) is kept at a desired rate in a stable condition during the initial and the long time of operation and the lumen maintenance is stable during the life.

As described above, when the molar ratio of $La_2O_3$ to $Y_2O_3$ is in a range of 19:1 to 1:9, the above-mentioned effect is remarkable. When the molar ratio of $La_2O_3$ to $Y_2O_3$ is greater than 19:1, the melting point of the solid solution is too high and the adhesion of the electron emission material (18) to the electrode substrate is deteriorated and the lumen maintenance after 6000 times is slightly lower than that of the conventional one as shown in Table 3.

When the molar ratio of $La_2O_3$ to $Y_2O_3$ is less than 1:9, the melting point of the solid solution is too high and the adhesion of the electron emission material (18) to the electrode substrate is deteriorated and the lumen maintenance after 6000 times is lower.

In said examples, the effects of the present invention have been shown in the cases that the mol % of BaO and CaO is the same as that of the conventional one. Thus, the similar effect can be attained even though the mol % of BaO or CaO is different.

The cases incorporating BaO and CaO as the alkaline earth metal oxide have been shown. In this embodiment, it is enough to contain at least BaO as the alkaline earth metal oxide. That is, the alkaline earth metal oxide can be only BaO or a combination of BaO and SrO or a combination of BaO, CaO and SrO.

The effect of the present invention can be attained even though a small amount of $Al_2O_3$, $SiO_2$ or tungsten is included into said electron emission material (18) of the present invention.

In the examples, the structure of the electrode shown in FIG. 2 has been used. The structure of the electrode can be the other feature shown in FIG. 3 wherein the inner coil (16) is wound on the electrode core (15) so as to remain rough wound parts and the outer coil (17) is wound on the inner coil to form the electrode substrate and the electron emission material (18) is filled in the space in the electrode substrate to be sintered.

The oxides have been incorporated in the electron emission material (18) in said embodiment. Thus, it is possible to use carbonates or oxalates and to convert them into oxides by sintering them after coating the electron emission material on the electrode substrate.

In accordance with the above-mentioned embodiment, the electron emission material comprising the alkaline earth metal oxide including at least BaO and $La_2O_3$ and $Y_2O_3$ is used, to improve the luminous flux deterioration in the initial period and to improve the productivity of the discharge lamp since a toxic beryllium oxide is not used.

The embodiment of an electrode of a fluorescent lamp will be illustrated.

Certain examples and a reference of the embodiment will be illustrated.

In Reference, a 40 W fluorescent lamp equipped with electrodes coated with an electron emission material consisting of 40 mol % of BaO, 30 mol % of SrO, 26 mol % of CaO and 4 mol % of $ZrO_2$ is prepared.

The electrode is prepared by mixing zirconium oxide with barium carbonate, strontium carbonate and calcium carbonate and admixing the mixture with nitrocellulose lacquer and butyl acetate in a ball mill to prepare a suspension and coating the suspension on a double wound coil or a triple wound coil made of tungsten and heating it in an exhausting process.

A life test of the 40 W fluorescent lamp is carried out. The starting voltage at 0° C. is 160 V and the lumen maintenance after 3000 hours of operation is 85%.

The examples of the present invention will be illustrated.

Each 40 W fluorescent lamp equipped with electrodes coated with an electron emission material consisting of $La_2O_3$ and $Y_2O_3$ at each ratio shown in Table 4 is prepared and the life test is carried out as set forth in Reference. The results are shown in Table 4.

TABLE 4

| | Composition of electron emission material (mol %) | Lumen maintenance after 3000 hours of operation (%) |
|---|---|---|
| Exp. 4-1 | $Y_2O_3$(93 mol %) - $La_2O_3$(7 mol %) | 85 |
| Exp. 4-2 | $Y_2O_3$(90 mol %) - $La_2O_3$(10 mol %) | 87 |
| Exp. 4-3 | $Y_2O_3$(75 mol %) - $La_2O_3$(25 mol %) | 95 |
| Exp. 4-4 | $Y_2O_3$(10 mol %) - $La_2O_3$(90 mol %) | 89 |
| Exp. 4-5 | $Y_2O_3$(7 mol %) - $La_2O_3$(93 mol %) | 85 |

As it is shown in Table 4, the lumen maintenance of the fluorescent lamps using the electron emission material comprising 10 to 90 mol % of $La_2O_3$ and 90 to 10 mol % of $Y_2O_3$ are remarkably superior to that of the electron emission material comprising $ZrO_2$.

The reason of the different characteristics is considered as follows.

In the conventional electron emission material, $ZrO_2$ prevents a reaction of BaO with tungsten of the electrode substrate to control the formation of Ba whereby a sputtering of Ba in the arc space can be decreased, however this is not enough and Ba is gradually deposited at the end of the tube during the life of the lamp so as to cause coloring.

On the contrary, in the electron emission material of the present invention, $La_2O_3$ and $Y_2O_3$ are used instead of Ba component. Both $La_2O_3$ and $Y_2O_3$ have heat resistance and good characteristics of emission. When both $La_2O_3$ and $Y_2O_3$ are combined, a mixed crystal or a complex compound is formed to improve the electron emitting characteristic. As a result, the combination of $La_2O_3$ and $Y_2O_3$ imparts the electron emitting characteristic substantially the same as that of the conventional one even though an alkaline earth metal oxide such as BaO is not incorporated. Therefore, the starting voltage of the fluorescent lamp using said combination is not inferior to that of the conventional fluorescent lamp using the known electron emission material.

The combination of $La_2O_3$ and $Y_2O_3$ performs the electron emission as the electron emission of a semiconductor without sputtering the metal element in the arc space in the operation as that of the conventional one. Therefore, the coloring at the end of the tube is not caused.

As described above, it is preferable to combine 10 to 90 mol % of $La_2O_3$ and 90 to 10 mol % of $Y_2O_3$, since a desired improvement of the electron emitting characteristic of the combination of $La_2O_3$ and $Y_2O_3$ is not found out of the range.

In the examples, the electron emission material consisting of $La_2O_3$ and $Y_2O_3$ has been used.

The effect of the present invention can be attained even though a small amount of $Al_2O_3$, $SiO_2$, $ZrO_2$ or tungsten is included in said electron emission material.

In the examples, the oxides have been shown as the electron emission material. Thus, the effect of the present invention can be attained by using a compound which is thermally convertible to the oxide such as a carbonate and heating it to convert it into the oxide.

In accordance with this embodiment, the electron emission material consisting of lanthanum oxide and yttrium oxide is used to obtain a fluorescent lamp having less black coloring at the end of the tube.

The other embodiment of the present invention will be illustrated. The reference is the same as the above-mentioned Reference. $La_2O_3$ and $Y_2O_3$ are combined with barium.strontium.calcium tungstate ($Ba_{1.8}Sr_{0.2}CaWO_6$) at various ratios as the electron emission material.

Each 40 W fluorescent lamp equipped with electrodes coated with each of the electron emission materials shown in Table 5 is prepared and the life test set forth in the above-mentioned embodiment is carried out. The results are shown in Table 5.

TABLE 5

| | Composition of electron emission material (mol %) | | | $La_2O_3$:$Y_2O_3$ (molar ratio) | Total of $La_2O_3$ and $Y_2O_3$ (mol %) | Starting voltage at 0°C.(V) | Lumen maintenance after 3000 hours of operation (%) |
|---|---|---|---|---|---|---|---|
| | $Ba_{1.8}Sr_{0.2}CaWO_6$ | $La_2O_3$ | $Y_2O_3$ | | | | |
| Exp. 5-1 | 90 | 0.8 | 9.2 | 1:12 | 10 | 160 | 85 |
| Exp. 5-2 | 90 | 1.0 | 9.0 | 1:9 | 10 | 155 | 87 |
| Exp. 5-3 | 90 | 2.5 | 7.5 | 1:3 | 10 | 150 | 95 |
| Exp. 5-4 | 90 | 9.0 | 1.0 | 9:1 | 10 | 150 | 90 |
| Exp. 5-5 | 90 | 9.5 | 0.5 | 19:1 | 10 | 155 | 85 |
| Exp. 5-6 | 90 | 9.6 | 0.4 | 24:1 | 10 | 160 | 85 |
| Exp. 5-7 | 99.4 | 0.15 | 0.45 | 1:3 | 0.6 | 160 | 72 |
| Exp. 5-8 | 99.0 | 0.25 | 0.75 | 1:3 | 1 | 155 | 87 |
| Exp. 5-9 | 70.0 | 7.5 | 22.5 | 1:3 | 30 | 155 | 85 |
| Exp. 5-10 | 65.0 | 8.8 | 26.2 | 1:3 | 35 | 170 | 70 |

As it is shown in Table 5, when the electron emission material comprising $Ba_{1.8}Sr_{0.2}CaWO_6$ and $La_2O_3$ and $Y_2O_3$ at a molar ratio of $La_2O_3$:$Y_2O_3$ of 19:1 to 1:9 and 1 to 30 mol % of a content of $La_2O_3$ and $Y_2O_3$ are used, the starting voltages are lower and the lumen maintenance are improved in comparison with those of the conventional electron emission material.

The reason of these characteristics is considered as follows.

In the conventional electron emission material, $ZrO_2$ prevents a reaction of BaO with tungsten of the electrode substrate to control the formation of Ba whereby a sputtering of Ba in the arc space can be decreased, however, the work function of the electron emission material is increased to cause higher starting voltage of the fluorescent lamp.

On the contrary, in the electron emission material of the present invention, both $La_2O_3$ and $Y_2O_3$ are used. Both $La_2O_3$ and $Y_2O_3$ have heat resistance and a good characteristic of electron emission. When both $La_2O_3$ and $Y_2O_3$ are combined a mixed crystal or a complex compound is formed to improve the electron emitting characteristic. As a result of the combination of $La_2O_3$—$Y_2O_3$ with $Ba_{1.8}Sr_{0.2}CaWO_6$, the electron emitting characteristic of $Ba_{1.8}Sr_{0.2}CaWO_6$ is further improved by the addition of $La_2O_3$-$Y_2O_3$. Therefore, the starting voltage of the fluorescent lamp may be lowered and the lumen deterioration may be decreased.

As described above, it is preferable to combine $La_2O_3$ and $Y_2O_3$ in a range of a molar ratio of 19:1 to 1:9 since a desired improvement of the electron emitting characteristic of the combination of $La_2O_3$ and $Y_2O_3$ is not found out of the range.

It is preferable to use 1 to 30 mol % of the total of $La_2O_3$ and $Y_2O_3$. When the total is less than 1 mol %, the effect of $La_2O_3$-$Y_2O_3$ for improving the electron emitting characteristic is not high enough and the starting voltage of the fluorescent lamp is high. When it is more than 30 mol %, a content of $Ba_{1.8}Sr_{0.2}CaWO_6$ as the source of Ba is relatively small and the electron emission is not enough and a black coloring at the end of the tube is caused.

In the examples, $Ba_{1.8}Sr_{0.2}CaWO_6$ has been used as the barium.strontium.calcium tungstate. The effect of the present invention can be attained by using the other tungstate having the formula $$Ba_{2-x}Sr_xCaWO_6 \text{ (x is 0 to 0.5).}$$

The effect of the present invention can be attained even though a small amount of $Al_2O_3$, $SiO_2$, $ZrO_2$ or tungsten is included in the said electron emission material.

In the examples, the tungstate and lanthanum oxide and yttrium oxide have been shown as the electron emission material. Thus, the effect of the present invention can be attained by using a compound which can be converted into said compound such as a mixture of barium carbonate, strontium carbonate and calcium carbonate with tungsten oxide and $La_2O_3$ and $Y_2O_3$ and heating it to convert it into the above-mentioned electron emission material.

In accordance with this embodiment, the electron emission material consisting of barium.strontium.calcium tungstate-($Ba_{2-x}Sr_xCaWO_6$:x is 0 to 0.5) and lanthanum oxide and yttrium oxide is used to obtain a fluorescent lamp having a lower starting voltage and less black coloring at the end of the tube.

The other embodiment of the present invention will be illustrated. The reference is the same as the above-mentioned Reference. $La_2O_3$ and $Y_2O_3$ are combined with a triple oxide of BaO, SrO and CaO at various ratios as the electron emission material. Each 40 W fluorescent lamp equipped with electrodes coated with each of the electron emission material shown in Table 6 is prepared and the life test set forth in the above-mentioned embodiment is carried out. The results are shown in Table 6.

TABLE 6

| | Composition of electron emission material (mol %) | | | | | $La_2O_3$:$Y_2O_3$ (molar ratio) | Total of $La_2O_3$ and $Y_2O_3$ (mol %) | Starting voltage at 0°C. (V) | Lumen maintenance after 3000 hours of operation (%) |
|---|---|---|---|---|---|---|---|---|---|
| | BaO | SrO | CaO | $La_2O_3$ | $Y_2O_3$ | | | | |
| Exp. 6-1 | 37.5 | 28.1 | 24.4 | 0.8 | 9.2 | 1:12 | 10 | 160 | 85 |
| Exp. 6-2 | 37.5 | 28.1 | 24.4 | 1.0 | 9.0 | 1:9 | 10 | 155 | 86 |
| Exp. 6-3 | 37.5 | 28.1 | 24.4 | 2.5 | 7.5 | 1:3 | 10 | 140 | 92 |
| Exp. 6-4 | 37.5 | 28.1 | 24.4 | 9.0 | 1.0 | 9:1 | 10 | 145 | 88 |
| Exp. 6-5 | 37.5 | 28.1 | 24.4 | 9.5 | 0.5 | 19:1 | 10 | 155 | 85 |
| Exp. 6-6 | 37.5 | 28.1 | 24.4 | 9.6 | 0.4 | 24:1 | 10 | 160 | 85 |
| Exp. 6-7 | 41.4 | 31.1 | 26.9 | 0.15 | 0.45 | 1:3 | 0.6 | 160 | 70 |
| Exp. 6-8 | 41.2 | 31.0 | 26.8 | 0.25 | 0.75 | 1:3 | 1 | 155 | 85 |
| Exp. 6-9 | 29.2 | 21.9 | 18.9 | 7.5 | 22.5 | 1:3 | 30 | 155 | 85 |

TABLE 6-continued

| | Composition of electron emission material (mol %) | | | | | $La_2O_3$: $Y_2O_3$ (molar ratio) | Total of $La_2O_3$ and $Y_2O_3$ (mol %) | Starting voltage at 0°C. (V) | Lumen maintenance after 3000 hours of operation (%) |
|---|---|---|---|---|---|---|---|---|---|
| | BaO | SrO | CaO | $La_2O_3$ | $Y_2O_3$ | | | | |
| Exp. 6-10 | 27.1 | 20.3 | 17.6 | 8.8 | 26.2 | 1:3 | 35 | 170 | 70 |

In the examples shown in Table 6, the molar ratios of Ba, Sr and Ca in the electron emission material are the same as 1:0.75:0.65.

As it is shown in Table 6, when the electron emission materials comprising $La_2O_3$ and $Y_2O_3$, at a molar ratio of $La_2O_3$:$Y_2O_3$ of 19:1 to 1:9 and 1 to 30 mol % of a content of $La_2O_3$ and $Y_2O_3$ are used, the starting voltage are lower and the lumen maintenance are improved in comparison with those of the conventional electron emission material containing $ZrO_2$.

The reason of these characteristics is considered as follows.

In the conventional electron emission material, $ZrO_2$ presents a reaction of BaO with tungsten of the electrode substrate to control the formation of Ba whereby a scattering of Ba in the arc space can be decreased, however, the work function of the electron emission material is increased to cause higher starting voltage of the fluorescent lamp.

On the contrary, in the electron emission material of the present invention, both $La_2O_3$ and $Y_2O_3$ are used. Both $La_2O_3$ and $Y_2O_3$ have heat resistance and a good characteristic of electron emission. When both $La_2O_3$ and $Y_2O_3$ are combined, a mixed crystal or a complex compound is formed to improve the electron emitting characteristic. As a result of the combination of $La_2O_3$-$Y_2O_3$ with the alkaline earth metal oxide such as BaO, the reaction of BaO with the electrode substrate is reduced and the electron emitting characteristic is improved. Therefore, the starting voltage of the fluorescent lamp may be lowered and the lumen deterioration may be decreased.

As described above, it is preferable to combine $La_2O_3$ and $Y_2O_3$ in a range of a molar ratio of 19:1 to 1:9 since a desired improvement of the electron emitting characteristic of the combination of $La_2O_3$ and $Y_2O_3$ is not found out of the range.

It is preferable to use 1 to 30 mol % of the total of $La_2O_3$ and $Y_2O_3$. When the total is less than 1 mol %, the effect of $La_2O_3$-$Y_2O_3$ for improving the electron emitting characteristic is not high enough and the starting voltage of the fluorescent lamp is high. When it is more than 30 mol %, the effect for reducing the reaction is too much, and the electron emission is not enough and a black coloring at the end of the tube is caused.

In the examples, the alkaline earth metal oxides of Ba, Sr and Ca at molar ratios of 1:0.75:0.65 have been combined with $La_2O_3$ and $Y_2O_3$. The effect of the present invention can be attained by using the other molar ratios of the alkaline earth metal oxides or the combination of BaO and SrO or BaO and CaO or only BaO.

The effect of the present invention can be attained even though a small amount of $Al_2O_3$, $SiO_2$, $ZrO_2$ or tungsten is included in the said electron emission material.

In the examples, the electron emission material has been shown as the oxides. Thus, the effect of the present invention can be attained by using a compound which can be converted into the oxides such as carbonates, for example, coating the mixture of the alkaline earth metal carbonates, $La_2O_3$ and $Y_2O_3$ on the electrode substrate and heating it to convert the carbonates into the oxides.

In accordance with this embodiment, the electron emission material consisting of the alkaline earth metal oxide including barium oxide and lanthanum oxide and yttrium oxide is used to obtain a fluorescent lamp having a lower starting voltage and less black coloring at the end of the tube.

What is claimed is:

1. In an electrode for a discharge lamp comprising an electrode substrate and an electron emission material on said electrode substrate, the improvement comprising said electron emission material consisting of a combination of 0.5 to 80 mole % of lanthanum oxide with 99.5 to 20 mole % of ytrrium oxide.

2. In an electrode for a discharge lamp comprising an electrode substrate and an electron emission material on said electrode substrate, the improvement comprising:

said electron emission material consisting of the combination of 10 to 90 mole % lanthanum oxide with 90 to 10 mole % of yttrium oxide.

* * * * *